US009399882B1

(12) United States Patent
McGrath

(10) Patent No.: US 9,399,882 B1
(45) Date of Patent: Jul. 26, 2016

(54) PORTABLE, ADJUSTABLE PANEL ASSEMBLY

(71) Applicant: Andrew H. McGrath, Concord, CA (US)

(72) Inventor: Andrew H. McGrath, Concord, CA (US)

( * ) Notice: Subject to any disclaimer, the term of this patent is extended or adjusted under 35 U.S.C. 154(b) by 208 days.

(21) Appl. No.: 14/322,080

(22) Filed: Jul. 2, 2014

(51) Int. Cl.
*A47B 5/04* (2006.01)
*E05D 11/10* (2006.01)

(52) U.S. Cl.
CPC ..... *E05D 11/1007* (2013.01)

(58) Field of Classification Search
USPC ..... 248/441.1, 444.1, 447, 449, 454, 456, 248/457, 462, 464
See application file for complete search history.

(56) References Cited

U.S. PATENT DOCUMENTS 498,578 A * 5/1893 Schmirk ..... A47B 7/08 182/129
2,449,492 A * 9/1948 Long ..... A47B 23/043 248/447
3,899,164 A * 8/1975 Newman ..... A47B 29/00 248/448
4,726,556 A * 2/1988 Weir ..... A47B 27/18 248/454
4,917,343 A * 4/1990 Wainscott ..... A47B 23/06 248/284.1
5,039,118 A * 8/1991 Huang ..... B62B 9/20 280/47.371
5,709,365 A * 1/1998 Howard ..... A47B 23/025 248/447.2
6,132,018 A * 10/2000 McGrath ..... A47F 3/007 248/398
6,202,973 B1 * 3/2001 Navarin ..... A47B 23/002 248/441.1
6,264,392 B1 * 7/2001 Wise ..... A42B 3/225 16/342
6,499,766 B1 * 12/2002 Schroeder ..... B42F 11/02 248/309.2
6,629,801 B2 * 10/2003 Cheng ..... B62B 9/20 280/642
7,617,569 B2 * 11/2009 Liao ..... B62B 3/12 16/297
8,403,430 B2 * 3/2013 Atkins ..... A47F 10/06 248/122.1
8,898,862 B1 * 12/2014 McGrath ..... E05D 11/1007 16/326
8,925,153 B1 * 1/2015 McGrath ..... E05D 11/1007 16/326
9,062,483 B1 * 6/2015 McGrath ..... E05D 3/02
2009/0289166 A1 * 11/2009 Hopfer ..... A47B 23/043 248/456

* cited by examiner

*Primary Examiner* — Bradley Duckworth
(74) *Attorney, Agent, or Firm* — Charles L. Thoeming

(57) ABSTRACT

A portable adjustable panel assembly provides end assemblies that include a plurality of adjustable hinged arms connected to a base element and a panel support element by hinge assemblies to support a panel and provide adjustable pivot of an attached panel 360 degrees about a longitudinal axis. Geometric recesses of the portable adjustable panel assembly components correspond to geometric ends of the hinge assemblies and access apertures in hinged arm ends allow the portable adjustable panel components to be releasably pivoted and repositioned, and then locked into a desired position relative one to the other. Panel positions relative to the assembly likewise are adjustable by similar manipulation of hinge assemblies corresponding to panel support element ends. The panel assembly can be collapsed into a substantially planar assembly for portability.

16 Claims, 3 Drawing Sheets

PORTABLE, ADJUSTABLE PANEL ASSEMBLY

CROSS-REFERENCES TO RELATED APPLICATIONS

Ornamental aspects of this invention have been disclosed in co-pending U.S. Design patent application Ser. No. 29/489,003 filed on Apr. 25, 2014. More detailed disclosures of various push-button locking hinge assemblies corresponding to the portable, adjustable panel assembly are provided in co-pending, U.S. Non-provisional Utility patent application Ser. No. 14/264,722, filed Apr. 29, 2014 (the "722 Application"), Ser. No. 14/307,900, filed Jun. 18, 2014 (the "900 Application"), and Ser. No. 14/311,941, filed Jun. 23, 2014 (the "941 Application") all of which are hereby incorporated in its entirety by reference.

STATEMENT REGARDING FEDERALLY SPONSORED RESEARCH OR DEVELOPMENT

None.

REFERENCE TO A MICRO-FICHE APPENDIX

None.

TECHNICAL FIELD

This invention relates to a portable, adjustable panel assembly that, for instance, is adaptable to ready-to-assemble components used in adjustable bracket assemblies for adapting to and connecting one or more substantially external support member(s) defined by the particular utility of the overall assembly to at least one fixed support structure, and for providing a locking hinge assembly to positionally adjust and secure a planar support member 360 degrees about a central hinge axis orthogonally disposed to the support structure.

BACKGROUND OF THE INVENTION

Portable, adjustable panel assemblies having lockable hinges for panel support or bracketing are well known in the art and typically comprise a limited degree of range of motion for a supported panel aligned with a central hinge axis, as exemplified by door-type hinge assemblies.

Designing and assembling portable, adjustable panel assemblies using these limited hinge elements is ordinarily complicated since dimensions, load factors, code requirements, and aesthetics converge to present brackets which are labor and component intensive. Often bracketing assemblies will have many component parts and require several tools for assembly. Moreover, with current technology, bracket assemblies, particularly portable, adjustable panel assemblies, require much broader ranges of hinge adaptability than what is provided in the art, and even when a custom design is presented, transporting, positioning and using the portable, adjustable panel assembly is cumbersome and overly time consuming.

Various types of portable, adjustable panel assemblies with adjustable and lockable hinges are used for securing bracketing components or bracketing assemblies integrally or to other external structures, and/or immobilizing and/or adjusting one component with respect to another component about a common axis. Many ready to assemble bracket assemblies utilize location dependent uprights or support members that multiply the effort needed to design and assemble adjustable and lockable hinge assemblies and that intensify the complexity of the process. The portability and ease of assembly for these panel assemblies is at best marginal.

Presently, most adjustable and lockable hinge assemblies for bracketing are initially assembled or installed by the seller because of the complexity of assembling. Thus, many bracketing assemblies are handled fully or most fully assembled which presents bulky cargo that takes up considerable amount of space and is difficult to transport. These assemblies do not provide any portability or rapid adjustment or operation.

Additionally, when one part of a piece of a portable and adjustable assembly is damaged, often the entire product must be returned instead of the damaged part. For example, when an adjustable and lockable hinge element for an upright or support bracketing assembly fails or is defective; often the entire bracketing assembly must be replaced.

Finally, the portable, adjustable bracket assembly needs to be supported by adequate and aesthetically pleasing attachment components for securing one or more integral hinge elements of the panel assembly to one or more adjustable panel assemblies or portable support structures.

There is, accordingly, a need for a portable, adjustable panel assembly that provides a simple to assemble and adjust portable, adjustable panel assembly.

Further there is a need for a portable, adjustable panel assembly that provides modular replacement components for hinge or bracketing elements of the portable, adjustable panel assembly.

There is also a need for a portable, adjustable panel assembly that provides adjustable and lockable hinge assemblies that enhance the portability or rapid adjustment or operation of the portable, adjustable panel assembly, and allows for easy adjustable and lockable hinge replacement.

DISCLOSURE OF INVENTION

The present invention relates to a portable, adjustable panel assembly that can be employed readily over a wide array of applications to securely connect a variety of longitudinally positional hinged support members to at least one fixed support structure, while still satisfying the complement of requirements presented by dimensions, load factors, codes, and design preferences. Furthermore, the portable, adjustable panel assembly disclosed and claimed herein is fashioned in such a manner as to maximize the utility of embodiments of portable, adjustable panel assembly, while minimizing the labor, parts and tools required for implementation. Since the portable, adjustable panel assembly is characterized by its universality and relative simplicity and ease of installation, it serves to fulfill both original and retrofit requirements for portable, adjustable panel assembly applications. The adjustability feature of the portable, adjustable panel assembly means that less "design customizing" is required for a given installation, thus leading to demonstrable cost savings.

For example, without limitation, an embodiment of the portable, adjustable panel assembly is adaptable to bracket assemblies for mounting, positioning and securing at least one longitudinally disposed bracket panel to at least one fixed support structure, and allowing for 360 degree positional adjustment of the longitudinally disposed bracket panel member along the adjustable and lockable hinge central axis of the portable, adjustable panel assembly.

The disclosed embodiments of a portable, adjustable panel assembly provide a plurality of integral hinge elements that join a base element, a plurality of intermediate hinged arms, and a fully adjustable, longitudinal panel support member.

The plurality of hinge elements allow for pivoting extension of the intermediate hinged arms between the base supports and the panel support member to provide a multitude of positional application options to each portable, adjustable panel assembly, depending on the needs and requirements of each separate installation. Geometric ends of the plurality of hinge elements allow insertion into any two adjacent intermediate hinged arms to be so releasably pivoted and repositioned, and then locked into a desired position relative one to the other. The hinge elements may include one or more of the embodiments disclosed in the 722 Application, the 900 Application, or the 941 Application.

BRIEF DESCRIPTION OF DRAWINGS

Further features and advantages will become apparent from the following detailed description made with reference to the accompanying drawings, wherein.

MODES FOR CARRYING OUT THE INVENTION

Figure 1:
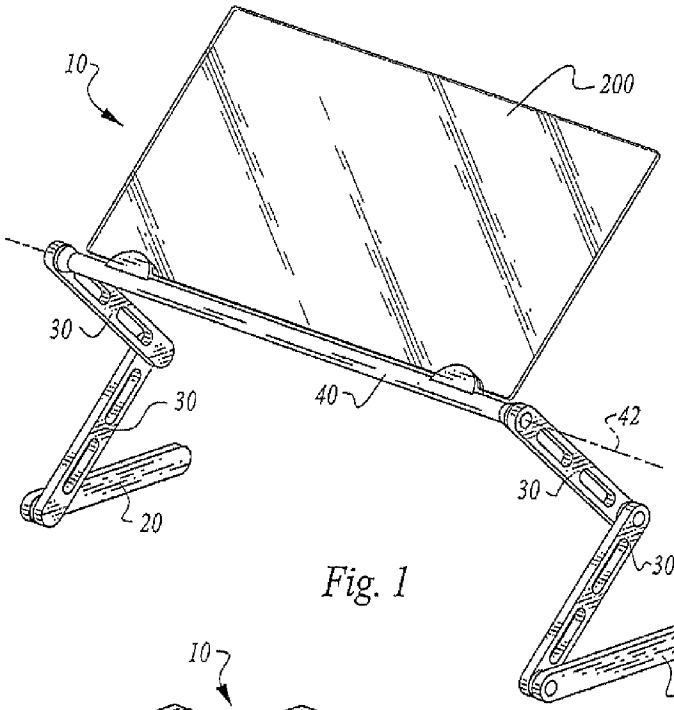
FIG. 1 is a perspective view of an embodiment of a portable, adjustable panel assembly that includes an adjustable panel support element 40 and a panel 200 that can be adjustably pivoted 360 degrees about a longitudinal panel support axis 42, in one possible configuration of the open portable, adjustable panel assembly 10.
Figure 2:
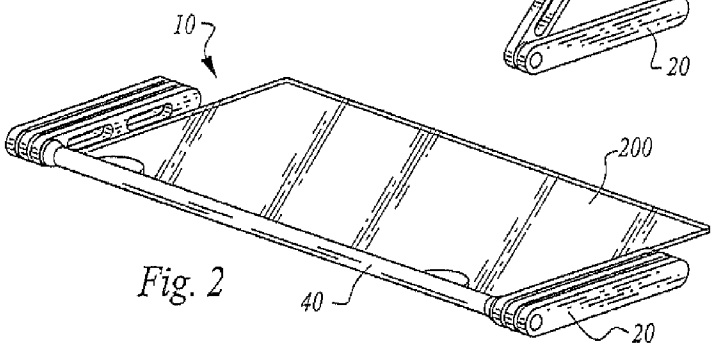
FIG. 2 is a perspective view of the embodiment of the portable, adjustable panel assembly 10 and panel 200 of FIG. 1, depicting a fully closed configuration of the portable, adjustable panel assembly 10 for easy transport.

This detailed description merely describes exemplary embodiments and is not intended to limit the scope of the claims in any way. Indeed, the invention as claimed is broader than and unlimited by the exemplary embodiments, and the terms used in the claims have their full ordinary meaning. For example, while the specific embodiments described herein relate to various assemblies using the portable, adjustable panel assembly for securing panel components in a variety of configurations or required positions for the use of the panel assembly as may be desired using bracketing components or bracketing assemblies integrally or to other external structures, and/or immobilizing and/or adjusting one component with respect to another component about a common axis, the exemplary features and embodiments of the present application may additionally or alternatively be applied to other types of portable, adjustable panel assemblies having locking hinge components, including, for example, various types of portable screens, panel bracketing, extending support hinges, folding hinges, rotisserie assemblies, frame hinges, hinges that permanently attach, releasably attach, and/or remain detached from a bracketing assembly, or other assembly providing one or more paired panel components to be rotated and secured, one relative to the other, and other types of uses, for example, with other portable items, such as, without limitation, sneeze guard assemblies, screens, tables, beds, panel stands, lecterns, carrying racks, storage racks, or furniture.

Further, persons with skill in the art understand that the terms "press fit" and "interference fit" are synonymous terms for a fit wherein one of the mating parts of an assembly is forced into a space provided by the other part in such a way that the condition of maximum metal overlap is achieved.

Referring now to FIG. 1-11, embodiments of portable, adjustable panel assemblies are illustrated and designated by reference numerals 10 and 12.

Figure 3:
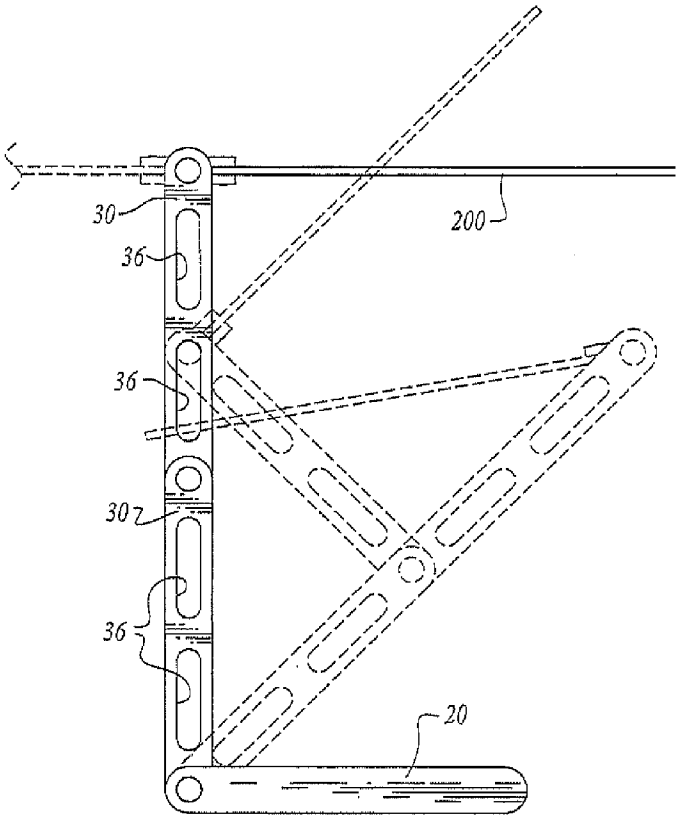
FIG. 3 is an orthogonal right side view of the embodiment of the portable, adjustable panel assembly 10 of FIG. 1, depicting at least three possible configurations of the open portable, adjustable panel assembly 10 and pivoted panel 200.
Figure 4:
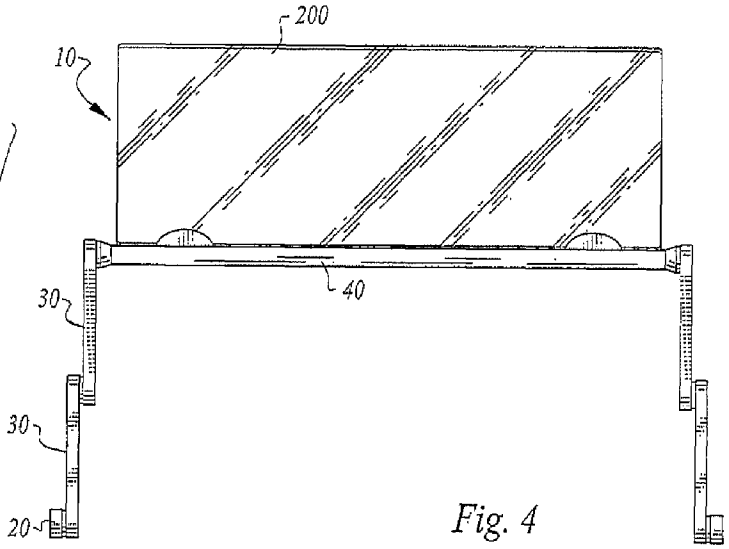
FIG. 4 is an orthogonal front view of the portable, adjustable panel assembly 10 of FIG. 1.
Figure 7:
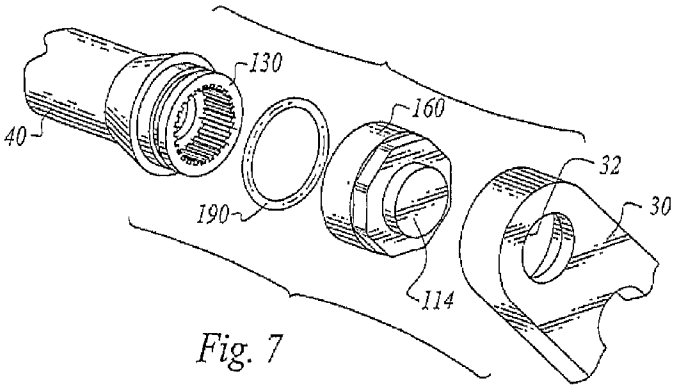
FIG. 7 is a partial detailed exploded perspective view of the adjustable panel support element 40 of FIG. 5, corresponding through a hinge assembly to the hinged arm 30 end providing a geometric fitting recess 34 and access aperture 32.
Figure 5:
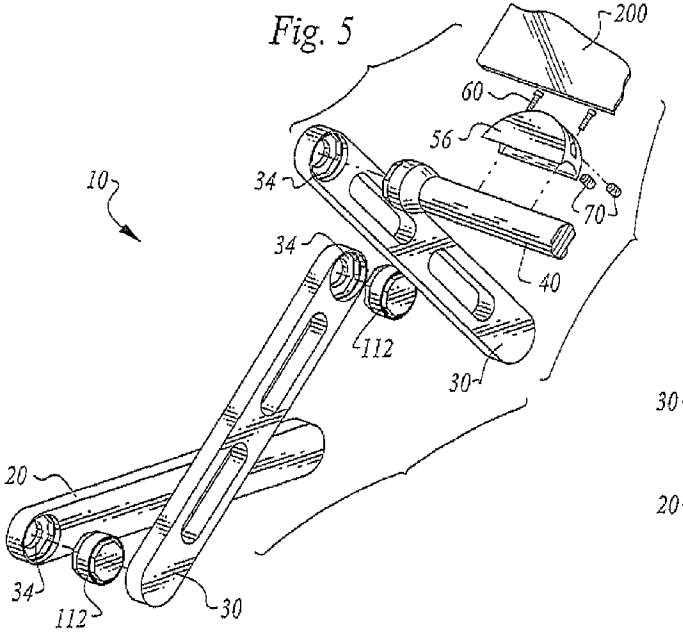
FIG. 5 is a partial detailed exploded perspective view of the embodiment of the portable, adjustable panel assembly 10 of FIG. 4.
Figure 6:
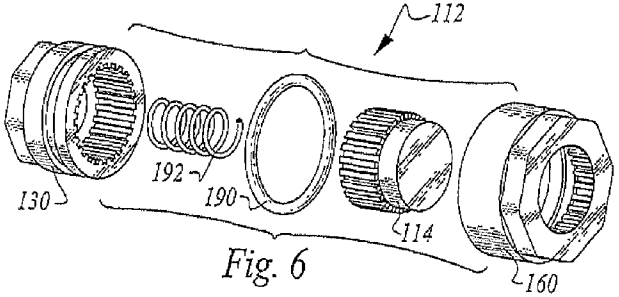
FIG. 6 is a partial detailed exploded perspective view of a push-button, locking hinge assembly 112, more specifically disclosed and claimed in the 722 Application, of FIG. 5.

An embodiment of a portable, adjustable panel assembly 10 includes at least one base element 20 having an end with a geometric fitting recess 34 side and an access aperture 32 side, where the access aperture 32 is centered within the geometric fitting recess 34, providing an access aperture 32 through the base element 20 end, FIGS. 1, 3, and 5.

An embodiment of a portable, adjustable panel assembly 10 includes a plurality of hinged arms 30, each hinged arm 30 having two ends and at least one channel opening 36 through the hinged arm between hinged arm ends. A geometric fitting recess 34 side and an access aperture 32 side are provided on a hinged arm 30 first end, where the access aperture 32 is centered within the geometric fitting recess 34, providing an access aperture 32 through each hinged arm 30 first end, FIGS. 1, 3-5. A geometric fitting recess 34 side corresponding to the hinged arm first end access aperture 32 side is provided on a hinged arm 30 second end, FIGS. 1, 3-5.

An embodiment of a push-button locking hinge assembly 112 that is sized to be interference fitted and received within each geometric fitting recess 34 is included. In this fashion, the push-button locking hinge assembly 112 push button 114 can be activated through an embodiment of a corresponding portable, adjustable panel assembly 10 element access aperture 32, FIGS. 1, 2-7. The embodiment of hinge assembly providing a push-button locking hinge assembly 112 provides a base 130, a cap 160, a push-button 114, an O-ring 190, and a resilient spring 192, FIGS. 6, 7 and 9. The cap 160 provides spacing between an embodiment of a corresponding portable, adjustable panel assembly 10 base 20 and hinged arm 30 elements, FIGS. 4-7. In this manner, the opened embodiment of a portable, adjustable panel assembly 10 provides supporting base 20 and hinged arm 30 assemblies, e.g., FIGS. 1 and 4, allow for a fully closed configuration of the open portable, adjustable panel assembly 10, the base 20 and hinged arm 30 elements of the portable, adjustable panel assembly 10 to be substantially flat for ease of portability, FIG. 2. The embodiment of adjustable panel assembly 12 likewise can be folded into a substantially flat closed configuration for ease of portability. A more detailed disclosure of the embodiment of the push-button locking hinge assembly 112 is provided in my co-pending, U.S. Non-provisional Utility patent application Ser. No. 14/264,722, filed Apr. 29, 2014 (the "722 Application") now issued on Dec. 2, 2014, as U.S. Pat. No. 8,898,896, which is hereby incorporated in its entirety by reference. It would be understood to those skilled in the art that alternative inventions for hinge assemblies as disclosed in my U.S. Non-provisional Utility patent application Ser. No. 14/307,900, filed Jun. 18, 2014 (the "900 Application") now issued on Jun. 23, 2015, as U.S. Pat. No. 9,062,483, and Ser. No. 14/311,941, filed Jun. 23, 2014 (the "941 Application") now issued on Jan. 6, 2015, as U.S. Pat. No. 8,925,153, which are hereby incorporated in their entirety by reference could be substituted for at least one embodiment of the push-button locking hinge assembly 112.

Figure 8:
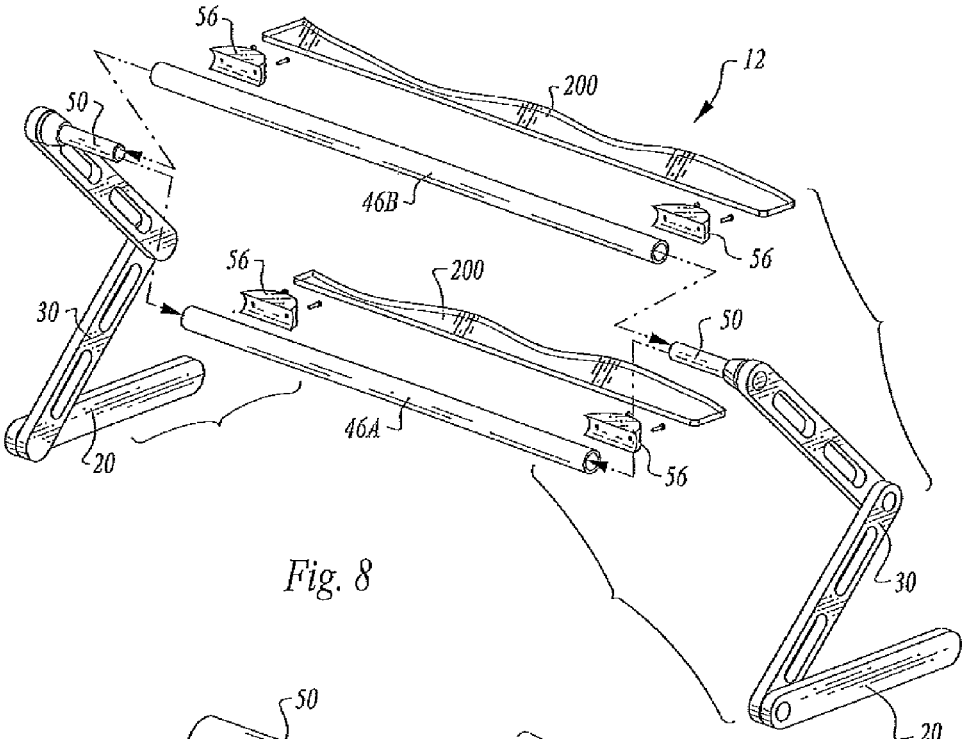
FIG. 8 is an exploded detailed perspective view of an embodiment of the portable, adjustable panel assembly 12. I, wherein varied lengths of the panel support element 46A or 46B can be adapted to the portable, adjustable panel assembly 12.
Figure 9:
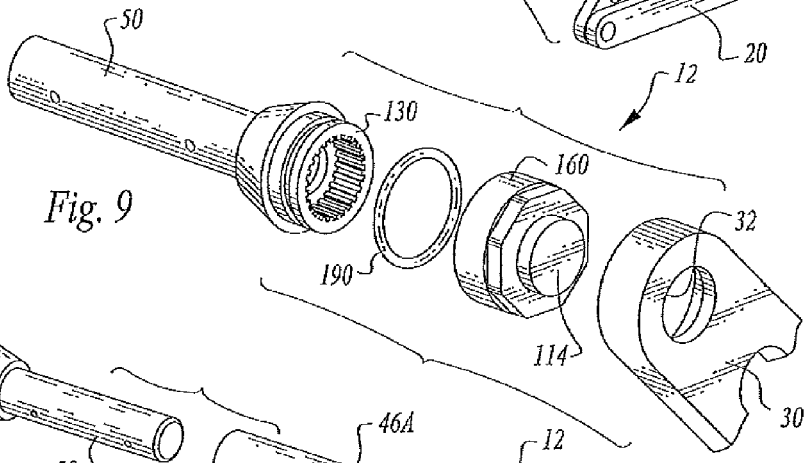
FIG. 9 is an exploded detailed perspective view of an embodiment of the portable, adjustable panel assembly 12 of FIG. 8, providing a panel support element extension 50 for the varied lengths of panel support element 46A or 46B.
Figure 10:
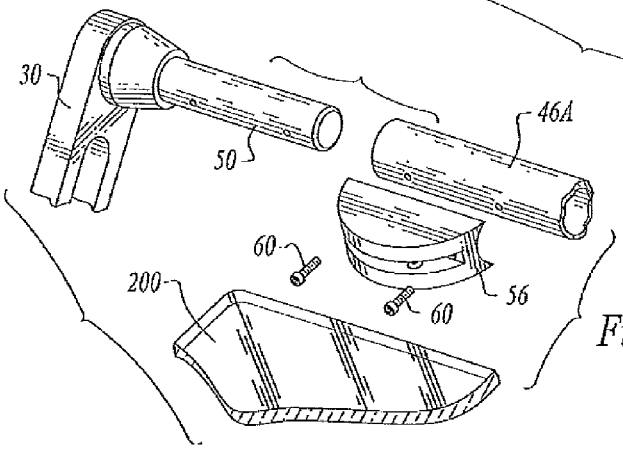
FIG. 10 is an exploded detailed perspective view of an embodiment of the portable, adjustable panel assembly 12 of FIG. 9, providing the locking hardware for the variable lengths of panel support element 46A or 46B to the panel support element extension 50.

For example, and without limitation, one of the hinge assemblies connecting the panel support extension 50 of FIGS. 8 and 9 to the top of the hinged arm 30 could be either a pull-button, locking hinge assembly of the 941 Application or a free-wheeling hinge assembly of the 900 Application, with the other hinge assembly connecting the panel support extension 50 to the top of the hinged arm 30 being the push-button locking hinge assembly 112. In this manner, a single person could manage the adjustment of the panel with respect to the supporting base—hinged arm supports on either side of the panel, FIGS. 3, 8-10. The hinge assemblies disclosed in the pull-button, locking hinge assembly of the 941 Application or a free-wheeling hinge assembly of the 900 Application have corresponding geometric ends sized to be interference fitted and received within each geometric fitting recess 34. The pull-button, locking hinge assembly of the 941 Application provides an actuating arm within the access aperture 32 side of the hinged arm 30 first end.

For further example, and without limitation, one or more of the hinge assemblies connecting the base element 20 to the hinged arm 30, and one hinged arm 30 to another hinged arm 30 could be a pull-button, locking hinge assembly of the 94. In this manner, a single person could manage the adjustment of the panel height with respect to the supporting base—hinged arm supports on either side of the panel, FIGS. 3, 8-10.

An embodiment of a portable, adjustable panel assembly 10 includes a panel support element 40 having a central longitudinal axis 42 and two panel support element 40 ends, each panel support element 40 end providing a geometric fitting recess 34, sized to receive and hold a push-button locking hinge assembly 112 base 130 interference fitted within the geometric fitting recess 34. At least two panel fitting elements 56 are fixedly attached to the panel support element 40 by fasteners 60. A preferred embodiment of the panel fitting element 56 includes a curved base sized to receive and correspond to the diameter of a preferred embodiment of the panel support element 40, FIG. 5. The preferred embodiment of the panel fitting element 56 further includes a slot sized to receive and hold a panel 200 by fasteners 70, FIG. 5.

An embodiment of a portable, adjustable panel assembly 12 includes at least two panel support extensions 50, each panel support extensions 50 having a cylindrical length and an end providing a geometric fitting recess 34, sized to receive and hold a push-button locking hinge assembly 112 base 130 interference fitted within the geometric fitting recess 34. The panel support extension 50 cylindrical length is sized to be received into an end of a varied length of panel support element 46A or 46B, FIGS. 8-10. In this manner, varied sizes of panels and lengths of panel support elements 46A or 46B can be interchanged into supporting base—hinged arm assemblies, e.g., FIGS. 8-10. The varied lengths of panel support element 46A or 46B are attached to the panel support extensions 50 by the same fasteners 60 used to secure the panel fitting element 56 to panel support element 46A or 46B, FIGS. 8-10.

Embodiments of the portable, adjustable panel assembly 10 and 12 elements, except for the O-ring and panel, can be manufactured from brushed aluminum, high strength carbon-composites, steel, stainless steel, and any similar light weight, high strength metal alloys. The preferred embodiments of the portable, adjustable panel assemblies 10 and 12 consist of brushed aluminum.

Embodiments of the portable, adjustable panel assembly can include a clear Plexiglas panel 200 or a tempered glass panel 200.

Embodiments of the portable, adjustable panel assembly 10 or 12 include use of an O-ring lubricant, such as DuPont® Krytox®, or Dow Corning® III O-Ring Valve Silicone Lubricant, or similar products to maintain the ease of motion for the pivot of the cap element 160 around the base element 130 along O-ring 190 within annular grooves of the cap and base elements.

Therefore, the foregoing is considered as illustrative only of the principles of the portable, adjustable panel assemblies. Additionally, since numerous modifications and changes will readily occur to those skilled in the art, it is not desired to limit the portable, adjustable panel assemblies to the exact construction and operation shown and described, and further, all suitable modifications and equivalents may be resorted to, falling within the scope of the portable, adjustable panel assemblies.

I claim:

1. A portable, adjustable panel assembly comprising, in combination:

a) a base comprising an end with a geometric fitting recess and an access aperture, where an access aperture is centered within a geometric fitting recess providing an access aperture through the base end with a geometric fitting;

b) a plurality of hinged arms, each hinged arm comprising (i) two ends, (ii) at least one channel opening through the hinged arm between hinged arm ends, (iii) a first geometric fitting recess and an access aperture on a hinged arm first end, with an access aperture centered within a geometric fitting recess, providing an access aperture through the hinged arm first end, and (iv) a second geometric fitting recess on a hinged arm second end and on a same hinged arm side as the hinged arm first end access aperture;

c) a plurality of hinge assemblies, each hinge assembly providing a push-button locking hinge assembly comprising, in combination (i) a base comprising a geometric end and an external circumferential O-ring channel, (ii) a cap comprising a geometric end and an internal circumferential O-ring channel, (iii) a push-button, (iv) an O-ring sized to be received within the base and cap O-ring channels, and (v) a resilient spring, wherein each push-button locking hinge assembly base is sized to be received within a corresponding a push-button locking hinge assembly cap such that the push-button locking hinge assembly cap and push-button locking hinge assembly base can pivot relative one to the other around the O-ring housed within the corresponding push-button locking hinge assembly base O-ring channel and the push-button locking hinge assembly cap O-ring channel, wherein each such push-button locking hinge assembly base and push-button locking hinge assembly cap house the resilient spring and push-button, and wherein each push-button, locking hinge assembly base geometric end and each push-button, locking hinge assembly cap geometric end is sized to be interference fitted and received within each portable, adjustable panel assembly geometric fitting recess such that the push-button locking hinge assembly push button can be activated through a corresponding portable, adjustable panel assembly element access aperture, whereby the hinge assemblies connect a plurality of hinged arms one to the other, and connect one base end to an unconnected hinge arm end;

d) a panel support element between at least two hinged arms;

e) at least two panel fitting elements, each panel fitting element comprising a panel attachment assembly to receive and fixedly hold a panel, and each panel fitting element fixedly attached to the panel support element by a fastener assembly;

f) a panel housed within the panel fitting elements.

2. The portable, adjustable panel assembly of claim 1, wherein the panel support element comprises (i) a central longitudinal axis, and (ii) two panel support element ends, each panel support element end comprising a geometric fitting recess sized to receive and hold a hinge assembly base geometric end corresponding to a hinged arm first end.

3. The portable, adjustable panel assembly of claim 2, wherein the panel support element further comprises a cylinder between the panel support element ends; and each panel fitting element further comprises a curved base sized to receive and correspond to the panel support element cylinder between the panel support element ends.

4. The portable, adjustable panel assembly of claim 1, wherein the panel attachment assembly comprises a panel fitting element slot sized to receive and hold a panel by fasteners communicating with the panel through a panel fitting element slot.

5. The portable, adjustable panel assembly of claim 2, wherein geometric fitting recesses, hinge assembly base geometric ends, and hinge assembly cap geometric ends are orthogonal to the panel support element central longitudinal axis.

6. The portable, adjustable panel assembly of claim 1, wherein means to support at least one panel between at least two hinged arms comprises at least two panel support extensions, each panel support extension comprising (i) a cylindrical length sized to be received into an end of a length of a cylindrical panel support element comprising a longitudinal central axis, and (ii) an end providing a geometric fitting recess sized to receive and hold a hinge assembly base geometric end corresponding to a hinged arm first end, whereby the length of panel support element is attached to the panel support extensions by the fasteners used to secure the panel fitting element to the length of panel support element.

7. The portable, adjustable panel assembly of claim 1, wherein all elements except the O-ring and panel comprise materials selected from the group consisting of brushed aluminum, high strength carbon-composites, steel, and stainless steel.

8. The portable, adjustable panel assembly of claim 1, wherein the panel comprises clear Plexiglas.

9. The portable, adjustable panel assembly of claim 1, wherein the panel comprises tempered glass.

10. A portable, adjustable panel assembly comprising, in combination;

a) a longitudinal support element comprising two ends and a longitudinal central axis;

b) at least one panel fitting element assembly affixed to the longitudinal support element by fasteners;

c) a panel housed within the at least one panel fitting element assembly;

d) portable, adjustable and pivoting means for (i) adjustably supporting the longitudinal support element ends to various positions above a substantially planar surface whereby the longitudinal support element longitudinal central axis is parallel to the planar surface, and (ii) locking the longitudinal support element into a desired position, the portable, adjustable and pivoting means comprising, in combination:

1) portable, adjustable panel assembly base comprising an end with a geometric fitting recess and an access aperture, where an access aperture is centered within a geometric fitting recess providing an access aperture through the base end with a geometric fitting;

2) a plurality of portable, adjustable panel assembly hinged arms, each hinged arm comprising (i) two ends, (ii) at least one channel opening through the hinged arm between hinged arm ends, (iii) a geometric fitting recess and an access aperture on a hinged arm first end, with an access aperture centered within a geometric fining recess, providing an access aperture through the hinged arm first end, and (iv) a second geometric fitting recess on a hinged arm second end and on a same hinged arm side as the hinged arm first end access aperture; and 3) a plurality of hinge assemblies, each hinge assembly providing a push-button, locking hinge assembly comprising, in combination, (i) a base comprising a geometric end and an external circumferential O-ring channel, (ii) a cap comprising a geometric end and an internal circumferential O-ring channel, (iii) a push-button, (iv) an O-ring sized to be received within the base and cap O-ring channels, and (v) a resilient spring, wherein each push-button locking hinge assembly base is sized to be received within a corresponding a push-button locking hinge assembly cap such that the push-button locking hinge assembly cap and push-button locking hinge assembly base can pivot relative one to the other around the O-ring housed within the corresponding push-button locking hinge assembly base O-ring channel and the push-button locking hinge assembly cap O-ring channel, wherein each such push-button locking hinge assembly base and push-button locking hinge assembly cap house the resilient spring and push-button, and wherein each push-button, locking hinge assembly base geometric end and each push-button, locking hinge assembly cap geometric end is sized to be interference fitted and received within each base and hinged arm geometric fitting recess such that the push-button locking hinge assembly push button can be activated through a corresponding base and hinged arm access aperture; whereby the hinge assemblies connect a plurality of hinged arms one to the other, and connect one base end to an unconnected hinge arm end; and e) portable, adjustable and pivoting means for rotating the panel in various positions 360 degrees about the longitudinal support element longitudinal central axis, and locking the panel in a desired position.

11. The portable, adjustable panel assembly of claim 10, wherein the portable, adjustable and pivoting means for rotating the panel in various positions 360 degrees about the longitudinal support element longitudinal central axis, and locking the panel in a desired position comprises hinge assemblies that connect the longitudinal panel support element to an unconnected hinge arm end.

12. The portable, adjustable panel assembly of claim 10, wherein the portable, adjustable and pivoting means for rotating the panel in various positions 360 degrees about the longitudinal support element longitudinal central axis, and locking the panel in a desired position comprises at least two panel support extensions, each panel support extension comprising (i) a length sized to be received into an end of the longitudinal support element, and (ii) an end providing a geometric fitting recess sized to receive and hold a hinge assembly base geometric end corresponding to a hinged arm first end, whereby the longitudinal support element is attached to the panel support extensions by fasteners used to secure the panel fitting element to the longitudinal panel support element, and whereby hinge assemblies connect each panel support extension to an unconnected hinge arm end.

13. The portable, adjustable panel assembly of claim 10, wherein geometric fitting recesses, hinge assembly base geometric ends, and hinge assembly cap geometric ends are orthogonal to the longitudinal support element longitudinal central axis.

14. The portable, adjustable panel assembly of claim 10, wherein all elements except the O-ring and panel comprise materials selected from the group consisting of brushed aluminum, high strength carbon-composites, steel, and stainless steel.

15. The portable, adjustable panel assembly of claim 10, wherein the panel comprises clear Plexiglas.

16. The portable, adjustable panel assembly of claim 10, wherein the panel comprises tempered glass.

* * * * *